US009080840B2

(12) United States Patent
Klug et al.

(10) Patent No.: US 9,080,840 B2
(45) Date of Patent: Jul. 14, 2015

(54) ELECTRONIC WEAPONRY WITH CANISTER FOR ELECTRODE LAUNCH

(71) Applicants: Scott L. Klug, Mesa, AZ (US); Milan Cerovic, Phoenix, AZ (US)

(72) Inventors: Scott L. Klug, Mesa, AZ (US); Milan Cerovic, Phoenix, AZ (US)

(73) Assignee: TASER International, Inc., Scottsdale, AZ (US)

( * ) Notice: Subject to any disclaimer, the term of this patent is extended or adjusted under 35 U.S.C. 154(b) by 105 days.

(21) Appl. No.: 13/625,775

(22) Filed: Sep. 24, 2012

(65) Prior Publication Data

US 2015/0002981 A1 Jan. 1, 2015

Related U.S. Application Data

(63) Continuation of application No. 12/827,979, filed on Jun. 30, 2010, now Pat. No. 8,320,098.

(51) Int. Cl.

| | |
|---|---|
| ***F42B 8/00*** | (2006.01) |
| ***F41H 13/00*** | (2006.01) |
| ***F41B 11/62*** | (2013.01) |

(52) U.S. Cl.

CPC ..... *F41H 13/0025* (2013.01); *F41B 11/62* (2013.01)

(58) Field of Classification Search

USPC ..... 361/232; 102/502; 42/1.08

See application file for complete search history.

(56) References Cited

U.S. PATENT DOCUMENTS

| | | | | |
|---|---|---|---|---|
| 3,025,845 | A | 9/1960 | Cardia | |
| 3,209,695 | A | 10/1965 | Crockford | |
| 3,924,382 | A | 12/1975 | Overkott | |
| 4,110,929 | A | 9/1978 | Weigand | |
| 4,819,609 | A | 4/1989 | Tippmann | |
| 4,846,044 | A * | 7/1989 | Lahr | 89/1.11 |
| 5,786,546 | A * | 7/1998 | Simson | 102/438 |
| 6,729,222 | B2 | 5/2004 | McNulty | |
| 7,042,696 | B2 | 5/2006 | Smith | |
| 7,490,598 | B2 | 2/2009 | Rice | |
| 7,673,411 | B1 | 3/2010 | Baldwin | |
| 7,891,128 | B2 | 2/2011 | Brundula | |
| 7,905,180 | B2 | 3/2011 | Chen | |
| 7,913,679 | B2 | 3/2011 | Quinn | |
| 8,286,621 | B2 | 10/2012 | Halmone | |
| 2003/0047174 | A1 | 3/2003 | Tiberius | |
| 2006/0187610 | A1 * | 8/2006 | Su | 361/232 |
| 2007/0151549 | A1 | 7/2007 | Wood | |
| 2007/0214993 | A1 | 9/2007 | Cerovic | |
| 2010/0050856 | A1 | 3/2010 | Baldwin | |

OTHER PUBLICATIONS

Murray, John, et al., "A Guide to TASER Technology: Stunguns, Lies and Videotape", 1997, Whitewater Press, Whitewater, Colorado, pp. 21-99, 109-143, and 224-233.

* cited by examiner

*Primary Examiner* — Danny Nguyen

(74) *Attorney, Agent, or Firm* — Lawrence Letham; William R. Bachand

(57) ABSTRACT

An electronic weapon with an installed deployment unit, from which wire-tethered electrodes are launched, provides a stimulus current through a target to inhibit locomotion by the target. A canister of compressed gas propels the electrodes. The canister is located in the deployment unit in a manner that facilitates the design and manufacture of a relatively narrow deployment unit.

14 Claims, 10 Drawing Sheets

ELECTRONIC WEAPONRY WITH CANISTER FOR ELECTRODE LAUNCH

CROSS-REFERENCE TO RELATED APPLICATIONS

This application is a continuation of and claims priority under 35 U.S.C. §120 from U.S. patent application Ser. No. 12/827,979 by Klug filed Jun. 30, 2010.

FIELD OF THE INVENTION

Embodiments of the present invention relate to electronic weaponry, deployment units, and structures for propelling electrodes, and to methods for providing a propellant to launch electrodes to provide a current through a human or animal target.

BACKGROUND OF THE INVENTION

Conventional electronic weapons use a propellant to launch one or more electrodes toward a human or animal target to deliver a stimulus signal through the target to inhibit locomotion by the target. A thin wire couples a signal generator in the electronic weapon to each launched electrode positioned in or near the target. The signal generator provides the stimulus signal through the target via the filament, the one or more electrodes, and a return path to complete a closed circuit. The return path may be through earth and/or through a second filament and electrode.

BRIEF DESCRIPTION OF THE DRAWING

Embodiments of the present invention are described with reference to the drawing, wherein like designations denote like elements, and.

DETAILED DESCRIPTION OF THE PREFERRED EMBODIMENTS

Figure 1:
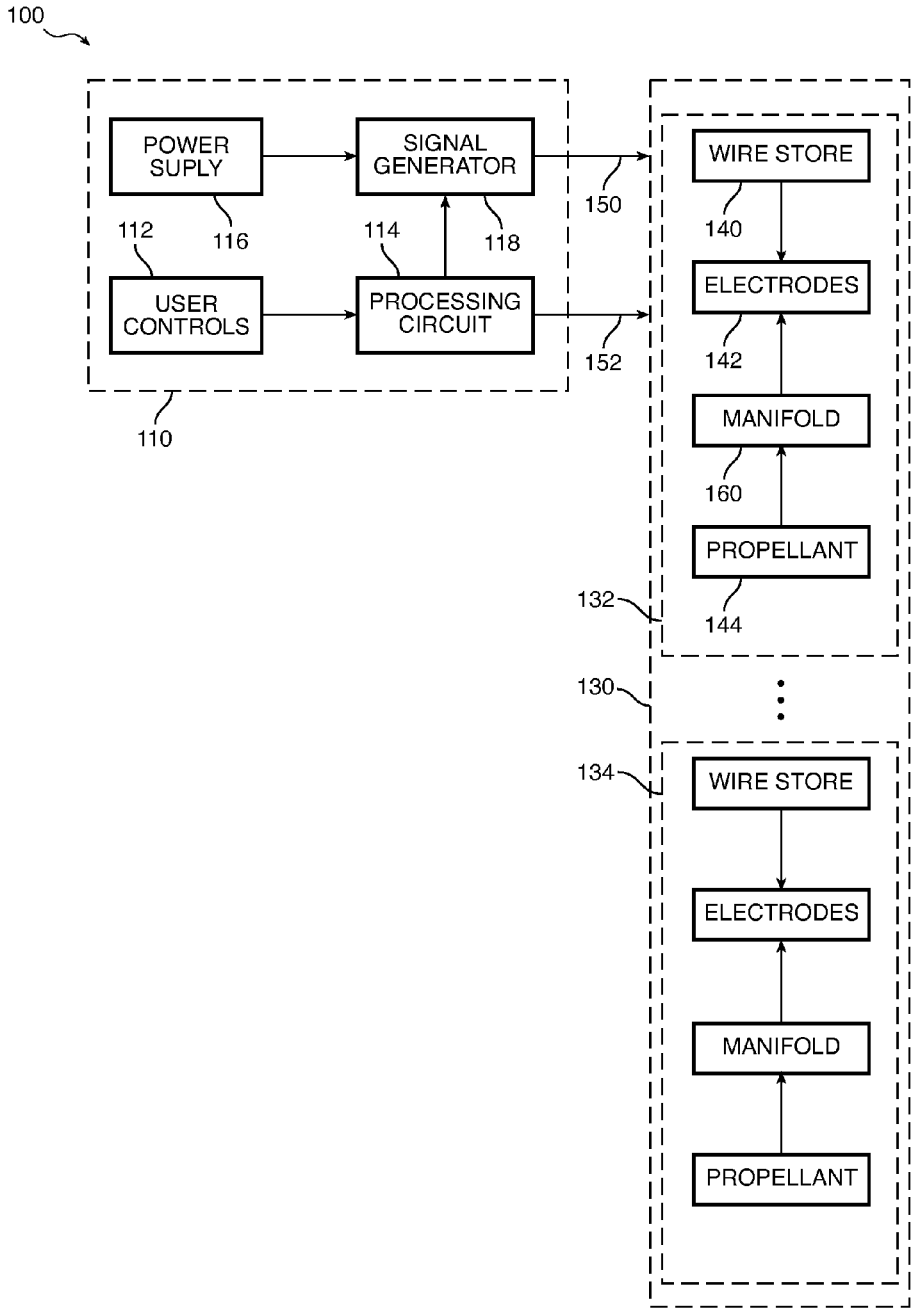
FIG. 1 is a functional block diagram of an electronic weapon according to various aspects of the present invention.
Figure 2:
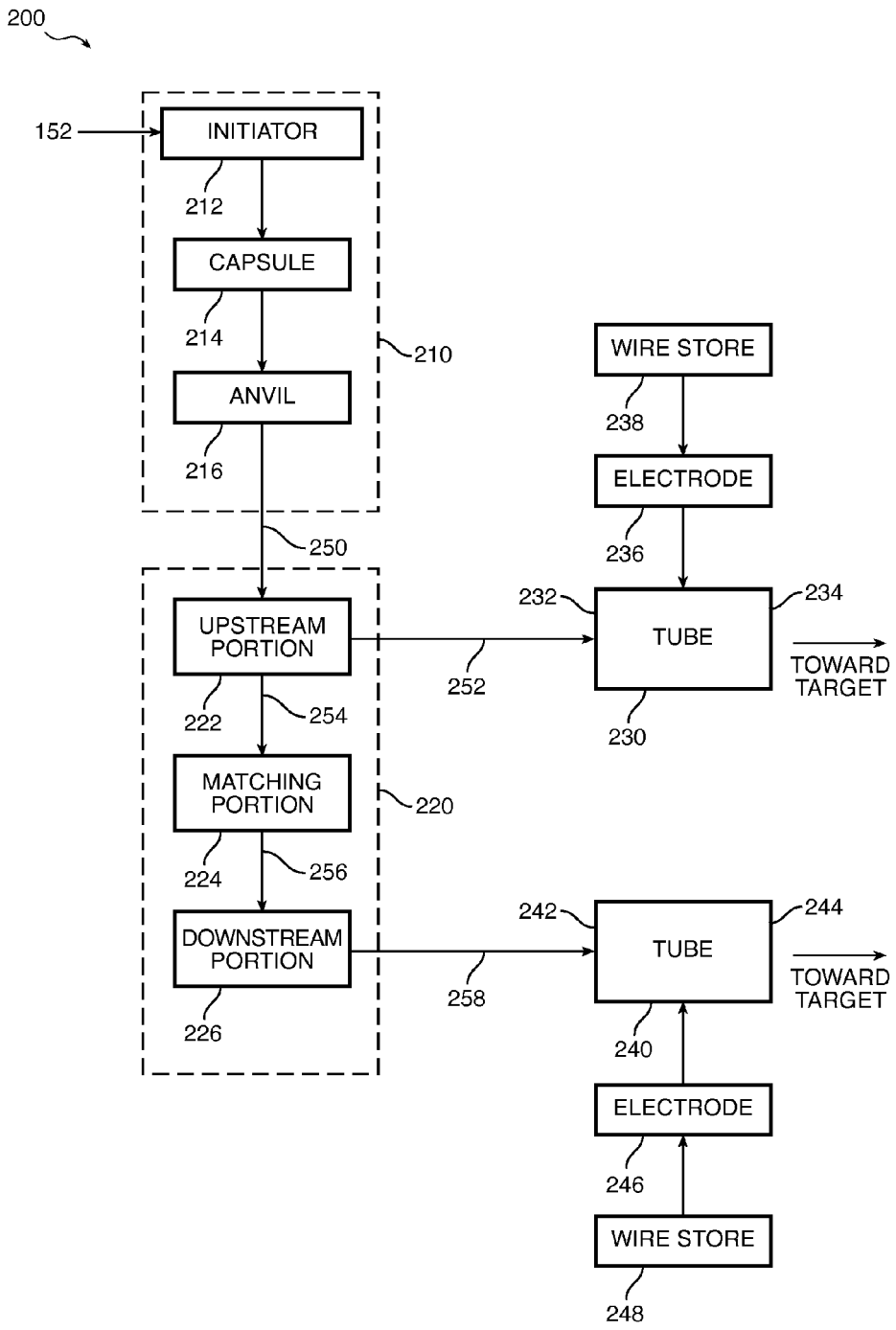
FIG. 2 is a functional block diagram of a cartridge according to various aspects of the present invention.

An electronic weapon delivers a current through a human or animal target to interfere with locomotion by the target. An important class of electronic weapons launch at least one wire-tethered electrode, also called a dart or a probe, toward a target to position the electrode in or near target tissue. A respective filament (e.g., wire with or without insulation) extends from the electronic weapon to each electrode at the target. One or more electrodes may form a circuit through a target. The circuit conducts a stimulus signal (e.g., current, pulses of current). The circuit may include a return path as discussed above. The electronic weapon provides the stimulus signal through, inter alia, the filament, the electrode, and the target to interfere with locomotion by the target. Interference includes causing involuntary contraction of skeletal muscles to halt voluntary locomotion by the target and/or causing pain to the target to motivate the target to voluntarily stop moving.

An electronic weapon may include a launch device and one or more field replaceable deployment units. Each deployment unit may include expendable (e.g., single use) components (e.g., tether wires, electrodes, propellant). Herein, the tether is interchangeably called a wire, a tether wire, and a filament. A wire-tethered electrode is an assembly of a filament and an electrode at least mechanically coupled to one end of the filament. The other end of the filament is at least mechanically coupled to the deployment unit and/or the launch device (e.g., one end fixed within the deployment unit), generally until the deployment unit is removed from the electronic weapon. As discussed below, mechanical coupling may facilitate electrical coupling of the launch device and the target prior to and/or during operation of the electronic weapon.

A launch device of an electronic weapon launches at least one wire-tethered electrode of the electronic weapon toward a target. As the electrode travels toward the target, the electrode deploys (e.g., pulls) a length of filament from a wire store. The filament trails the electrode. After launch, the filament spans (e.g., extends, bridges, stretches) a distance from the launch device to the electrode generally positioned in or near a target.

Electronic weapons that use wire-tethered electrodes, according to various aspects of the present invention, include handheld devices, apparatus fixed to buildings or vehicles, and stand-alone stations. Hand-held devices may be used in law enforcement, for example, deployed by an officer to take custody of a target. Apparatus fixed to buildings or vehicles may be used at security checkpoints or borders, for example, to manually or automatically acquire, track, and/or deploy electrodes to stop intruders. Stand-alone stations may be set up for area denial, for example, as used by military operations.

Conventional electronic weapons such as the model X26 electronic control device and Shockwave™ area denial unit marketed by TASER International, Inc. may be modified to implement the teachings of the present invention by replacing the conventional deployment units with deployment units having the invention as discussed herein.

A deployment unit includes a propellant for providing a propelling force, a structure for transporting a propelling force, and one or more electrodes. A propellant provides a propelling force (e.g., rapidly expanding gas) for propelling one or more electrodes. A propelling force may propel an electrode away from a deployment unit and toward a target. A propelling force may be released responsive to an action by a user (e.g., trigger pull) of the electronic weapon, a target (e.g., trip wire pull), and/or a detector (e.g., motion sensor). A propelling force may be released as a sequence of events. Events may include activating an initiator, igniting pyrotechnic materials, propelling a capsule of compressed gas, piercing a capsule of pressurized gas, and/or releasing a pressurized gas. Events that occur to release a propelling force may occur in any practical order.

In one implementation, an electrically ignited pyrotechnic material propels a sealed capsule of compressed gas (e.g., nitrogen) against an anvil. The anvil punctures the capsule to release a compressed gas. The pyrotechnic material, capsule, and an anvil are contained in a canister.

A manifold includes any structure (e.g., tube plenum) for transporting (e.g., delivering, directing, guiding) a propelling force to one or more electrodes for launching the electrodes. Transporting a propelling force includes directing a flow of a pressurized gas. A manifold may essentially consist of a cavity in a structure of a deployment unit. A manifold may receive a propelling force from one or more origins. A manifold may merge propelling forces from different origins. A manifold may direct a propelling force to a plurality of destinations (e.g., inlet, outlet). A manifold may divide a propelling force in to two or more flows of respective propelling forces. A manifold may deliver a first flow to a first destination and a second flow to a second destination. For example, a manifold may receive a propelling force from a canister. A manifold may transform (e.g., change, alter, adjust) a characteristic (e.g., pressure, flow velocity, rate of fluid flow, direction of flow) of a propelling force.

A manifold may include structures that form passages, bores, orifices, tubes, inlets, outlets, baffles, throttles, and expansion chambers. A passage may be of any shape (e.g., circular, square, "D" shaped). Components of a deployment unit may be assembled to form a manifold. A manifold may include inlets and outlets. A manifold receives a propelling force via an inlet. A manifold may release a propelling force via an outlet. A portion of a manifold may be straight. A portion of a manifold may be curved.

A manifold may fluidly couple other structures (e.g., bores, passages, chambers, throttles, baffles, tubes). A throttle includes an inlet and an outlet. A throttle may receive a first flow of gas at an inlet and provide a second flow of gas at an outlet. A throttle may receive a first flow of gas having a first characteristic and provide a second flow of gas having a second characteristic. A throttle increases a pressure of a gas at its inlet. A baffle deflects a flow of gas. An expansion chamber permits the expansion of a gas with a concomitant decrease in a pressure of the gas.

A manifold, according to various aspects of the present invention, transports a force to two or more electrodes in such a manner as to increase a correspondence (e.g., match, similarity) between respective exit velocities and/or times of exit of the two or more electrodes from a deployment unit. Increasing a correspondence between an exit velocity and/or a time of exit of two or more electrodes may increase an accuracy of deployment of the two or more electrodes toward a target. Accuracy of delivery increases a likelihood of forming a circuit with a target via two or more electrodes. Delivery of at least two electrodes to a target permits at least one electrode to function as a return path for a stimulus signal.

An electrode provides a mass for launching toward a target. The intrinsic mass of an electrode includes a mass that is sufficient to fly, under force of a propellant, from a launch device to a target. The mass of the electrode includes a mass that is sufficient to deploy (e.g., pull, uncoil, unravel, draw) a filament from a wire store. The mass of the electrode is sufficient to deploy a filament behind the electrode while the electrode flies toward a target. The mass of the electrode deploys the filament from the wire store and behind the electrode in such a manner that the filament spans a distance between the launch device and the electrode positioned at a target. The mass of an electrode is generally insufficient to cause serious blunt impact trauma to a target. In one implementation, the mass of an electrode is in the range of 2.0 to 3.0 grams, preferably about 2.8 grams.

An electrode receives a propelling force to propel the electrode toward a target. A magnitude of a propelling force is sufficient to accelerate an electrode from a state of rest, remove (e.g., break, jettison, push aside) a protective cover (e.g., blast door) of the deployment unit, launch an electrode away from a deployment unit, propel the electrode a distance between a launch device and a target, and deploy a filament between the launch device and the electrode.

An electrode includes a shape for receiving a propelling force to propel the electrode toward a target. An electrode provides a surface area for receiving a propelling force to propel the electrode away from a launch device and toward a target. A shape of an electrode may correspond to a shape of a portion of the launch device or deployment unit that provides a propelling force to propel the electrode. The portion of the launch device or deployment unit that stores (e.g., holds, retains) the electrode prior to receiving the propelling force may establish a preliminary trajectory of the electrode.

Prior to launch, one or more electrodes are positioned at rest in a deployment unit. Responsive to the propelling force, the one or more electrodes accelerate and exits (e.g., leaves) the deployment unit. An electrode exits a deployment unit at a velocity (e.g., exit velocity, muzzle velocity). During a launch, two or more electrodes may exit a deployment unit.

For example, a cylindrical electrode may be propelled from a cylindrical tube of a deployment unit. During a launch of an electrode by an expanding gas, the electrode may seal the tube with the body of the electrode to accomplish suitable acceleration and exit velocity. A rear face of the cylindrical body may receive substantially all of the propelling force. A sealing device (e.g., poron pad, pad, seal) may cooperate with an electrode to seal the tube to harness the propelling force to propel the electrode. Movement of the electrode along the tube during a launch establishes a preliminary direction of travel (e.g., trajectory) of the electrode upon exit of the electrode from the tube.

In one implementation, an electrode includes a substantially cylindrical body. Prior to launch, the electrode is positioned in a substantially cylindrical tube slightly larger in diameter than the electrode. An inlet of the tube toward a rear portion of the electrode is in fluid communication with a manifold. A manifold is in fluid communication with a source of a propelling force. During a launch, the propelling force is released. The manifold transports the expanding gas to the inlet of the tube. The propelling force is applied to a rear portion of the tube. The gas pushes against a rear portion of the body of the electrode to propel the electrode out the other end (e.g., forward portion, exit) of the tube toward a target.

A time and/or velocity of exit of an electrode from a deployment unit is related to a time of application of a propelling force upon the electrode and/or the characteristics of the propelling force. A manifold determines the time of application and/or the characteristics of the propelling force provided to each electrode.

Movement of the electrode after exit from a launch device and/or deployment unit is limited by aerodynamic drag and resistance force (e.g., tension in the filament) that resists deploying a filament from a wire store and pulling the filament behind the electrode in flight toward a target.

A forward portion of an electrode may be oriented toward a target prior to launch. Upon launch and/or during flight from the launch device toward the target, the forward portion of the electrode orients toward the target. An electrode includes a shape and a surface area for aerodynamic flight for suitable accuracy of delivery of the electrode across a distance toward a target, for example, about 15 to 35 feet from a launch device to a target. An electrode may rotate in-flight to provide spin stabilized flight. An electrode may maintain its pre-launch orientation toward a target during launch, flight to, and impact with a target.

An electrode mechanically couples to a filament to deploy the filament from a wire store and to extend the filament from the launch device to the target. A mechanical coupling may be established between a filament and an electrode in any conventional manner. Mechanical coupling includes coupling a filament and an electrode with sufficient strength to retain the coupling during manufacture, prior to launch, during launch, after launch, during mechanical coupling of the electrode to a target, and while delivering a stimulus signal to a target.

An electrode facilitates electrical coupling of the launch device and the target. Electrical coupling generally involves a region or volume of target tissue associated with the electrode (e.g., a respective region for each electrode when more than one electrode is used). For each electrode, electrical coupling may include placing the electrode in contact with target tissue and/or ionizing air in one or more gaps between the launch device, the deployment unit, the filament, the electrode, and target tissue.

For example, a placement of an electrode with respect to a target that results in a gap of air between the electrode and the target does not electrically couple the electrode to the target until ionization of the air in the gap. Ionization may be accomplished by a stimulus signal that includes, at least initially, a relatively high voltage (e.g., about 25,000 volts for one or more gaps having a total distance of about one inch). After initial ionization, the electrode remains electrically coupled to the target while the stimulus signal supplies sufficient current and/or voltage to maintain ionization.

A cartridge for use with a deployment unit and/or an electronic weapon, according to various aspects of the present invention, performs the functions discussed herein. For example, any of cartridges 133, 134, 200, 320, 330, 340 and 400 of FIGS. 1-9 may provide a propelling force to increase a correspondence between an exit velocity and/or a time of exit of two or more electrodes toward a target to establish a circuit with the target to provide a stimulus signal through the target.

Electronic weapon 100 of FIG. 1 includes launch device 110 and deployment unit 130. Launch device 110 includes user controls 112, processing circuit 114, power supply 116, and signal generator 118. In one implementation, launch device 110 is packaged in a housing. The housing may include a mechanical and electrical interface for a deployment unit. Conventional electronic circuits, processor programming, propulsion, and mechanical technologies may be used except as discussed herein.

A user control is operated by a user to initiate an operation of the weapon. User controls 112 may include a trigger operated by a user. When user controls 112 are packaged separately from launch device 110, any conventional wired or wireless communication technology may be used to link user controls 112 with processing circuit 114.

A processing circuit controls many if not all of the functions of an electronic weapon. A processing circuit may initiate a launch of one or more electrodes responsive to a user control. A processing circuit may control an operation of a signal generator to provide a stimulus signal. For example, processing circuit 114 receives a signal from user controls 112 indicating user operation of the weapon to launch one or more electrodes and to provide a stimulus signal. Processing circuit 114 provides launch signal 152 to deployment unit 130 to initiate launch of one or more electrodes. Processing circuit 114 may provide a signal to signal generator 118 to provide a stimulus signal to the launched electrodes. Processing circuit 114 may include a conventional microprocessor and memory that executes instructions (e.g., processor programming, firmware, object code, machine code) stored in memory.

A power supply provides energy to operate an electronic weapon and to provide a stimulus signal. For example, power supply 116 provides energy (e.g., current, pulses of current) to signal generator 118 to provide a stimulus signal. Power supply 116 may further provide power to operate processing circuit 114 and user controls 112. For hand-held electronic weapons, a power supply generally includes a battery.

A signal generator provides a stimulus signal for delivery through a target. A signal generator may transform energy provided by a power supply to provide a stimulus signal having suitable characteristics (e.g., ionizing voltage, charge delivery voltage, charge per pulse of current, current pulse repetition rate) to interfere with target locomotion. A signal generator electrically couples to a filament to provide the stimulus signal through the target as discussed above. For example, signal generator 118 provides a conventional stimulus signal (e.g., 17 pulses per second, each pulse capable of ionizing air, each pulse delivering after ionization about 80 microcoulombs to a human target having an impedance (e.g., after ionization) of about 400 ohms) to electrodes 142 of deployment unit 130 via their respective filaments (e.g., wires in store 140). Signal generator 118 is electrically coupled to filaments stored in wire store 140 via stimulus interface 150.

A deployment unit (e.g., cartridge, magazine) receives a launch signal from a launch device to initiate a launch of one or more electrodes and to provide a stimulus signal for delivery through a target. A spent deployment unit may be replaced with an unused deployment unit after some or all electrodes of the spent deployment unit have been launched. An unused deployment unit may be coupled to the launch device to enable additional electrodes to be launched. A deployment unit may receive signals from a launch device to perform the functions of a deployment unit via an interface.

For example, deployment unit 130 includes two or more cartridges 132-134. Each cartridge 132-134 includes propellant 144, manifold 160, one or more electrodes 142, and wire store 140. A wire store stores a filament for each electrode. Each filament mechanically couples to an electrode as discussed above. Each filament may electrically couple to an electrode as discussed herein. Processing circuit 114 initiates activation of propellant 144 for a selected cartridge via launch signal 152. Propellant 144 provides a propelling force. Manifold 160 transports the propelling force to electrodes 142 to propel electrodes 142 toward a target. Manifold 160, according to various aspects of the present invention, provides the propelling force to increase a correspondence of an exit velocity and/or a time of exit of two or more electrodes 142 as discussed herein. Each electrode is coupled to a respective filament in wire store 140. As each electrode flies toward the target, the electrode deploys its respective filament from wire store 140. Signal generator 118 provides a stimulus signal through the target via stimulus interface 150 and the filaments coupled to electrodes 142.

In another example, cartridge 200 includes canister 210, manifold 220, tubes for electrodes 230 and 240, electrodes 236 and 246, and wire stores 238 and 248. A canister provides a propelling force. Canister 210 may include initiator 212, capsule 214, and anvil 216. Manifold 220 includes upstream portion 222, matching portion 224, and downstream portion 226.

Electrodes 236 and 246 are positioned in tubes 230 and 240 respectively. Tubes 230 and 240 include inlet 232 and 242 respectively. Tubes 230 and 240 include exits 234 and 244 respectively. Inlets are positioned at a rear portion and outlets at a forward portion of a tube. An inlet receives a propelling force to propel an electrode out the exit of a tube. Upon launch electrode 236 exits tube 230 out exit 234 and electrode 246 exits tube 240 out exit 244. Each electrode 236 and 246 deploys a filament stored in wire store 238 and 248 respectively.

An initiator may include pyrotechnic material. Activating an initiator may be accomplished in any conventional manner (e.g., applying percussion, applying an electrical signal). Pyrotechnic material may include a combustible material (e.g., gun powder) that burns responsive to a launch signal. Pyrotechnic material burns to produce an expanding gas. Pyrotechnic material may be positioned in a sealed chamber proximate to a capsule. An expanding gas from burning pyrotechnic material may translate (e.g., move, push) a capsule from a pre-ignition position to a post-ignition position.

A capsule contains a pressurized gas. A capsule releases a pressurized gas to propel one or more electrodes. A capsule may include a structure for releasing the gas. A structure for releasing may include a scoring of the material of the capsule to reduce an amount of pressure to open (e.g., puncture) the capsule. A scoring may further restrict an opening to a selected area. A capsule may cooperate with a conventional initiator and an anvil to open the capsule. An initial pressure of a gas contained in a capsule generally determines a range of the one or more electrodes to be launched by release of the gas.

An anvil pierces a capsule to release a pressurized gas. An anvil may include a pointed portion for piercing. An anvil may include a passage for directing a flow of pressurized gas. A capsule may be pressed against an anvil to accomplish piercing.

An initiator, a capsule, and an anvil may be contained in a canister. A canister may include an exit for an escape of a pressurized gas. An anvil may be mounted to the canister proximate to the exit. An orifice of an anvil may form an exit of the canister. The initiator may be positioned in the canister distal from the exit of the canister. A capsule may be positioned between the initiator and the anvil. A seal may be positioned between the initiator and the capsule.

An expanding gas from activating an initiator may press the capsule against the anvil. Pressing the capsule against the anvil may open the capsule. Opening the capsule releases the pressurized gas contained in the capsule. The pressurized gas exits through a passage in the anvil and out an exit of the canister. An exit of a canister may be positioned proximate to a manifold.

For example, initiator 212, capsule 214, and anvil 216 are positioned in canister 210. Anvil 216 is positioned proximate to an exit of canister 210. Initiator 212 is positioned distal from the exit of canister 210. Capsule 214 is positioned between initiator 212 and anvil 216. A seal (not shown) may be positioned between initiator 212 and capsule 214 to contain, at least for a time, an expanding gas provided by initiator 212. Responsive to launch signal 152, initiator 212 ignites, burns, and produces an expanding gas. The pressure of the expanding gas from initiator 212 presses capsule 214 against anvil 216. Pressure of capsule 214 against anvil 216 opens capsule 214. Opening capsule 214 releases a pressurized gas from capsule 214. Pressurized gas from capsule 214 escapes from canister 210 and enters manifold 220. The seal between initiator 212 and capsule 214 may contain the gas from activating initiator 212 for a time after the pressurized gas from capsule 214 has been released and possibly for a time after electrodes 236 and 246 have exited the deployment unit.

As discussed above, a manifold may transport a pressurized gas for launching one or more electrodes. As set forth above, a manifold may include an upstream portion, a matching portion, and a downstream portion.

An upstream portion fluidly couples to an inlet of a tube for launching an electrode. An upstream portion fluidly couples to the matching portion. An upstream portion receives a flow (e.g., stream, volume) of pressurized gas from the canister. An upstream portion provides a portion of the flow of the pressurized gas to an inlet of a tube for launching an electrode. A magnitude of gas pressure at the inlet of the tube determines an exit velocity of the electrode. A timing of providing a gas pressure at the inlet of the tube determines an exit time of the electrode from the tube. An upstream portion provides a portion of the flow of the pressurized gas to a matching portion.

A matching portion fluidly couples to a downstream portion. A matching portion receives a flow of pressurized gas from the upstream portion. A matching portion may transform a characteristic (e.g., pressure, speed of flow, amount of flow) of the pressurized gas from the upstream portion. A matching portion may transform a characteristic of a pressurized gas in an upstream portion, a downstream portion, or both. A transformation (e.g., change, alteration, adjustment) of a characteristic of the pressurized gas increases a correspondence of an exit velocity and/or an exit time of two or more electrodes.

A downstream portion fluidly couples to a tube for launching an electrode. A downstream portion receives a flow of pressurized gas from a matching portion. A matching unit may transform a characteristic of a flow of gas before providing the flow to the downstream portion. A downstream portion may transform a characteristic of the flow of pressurized gas within the downstream portion. A transformation of a characteristic of a flow of pressurized gas may increase a correspondence of a time of exit and/or a velocity of exit of two or more electrodes.

For example, upstream portion 222 of manifold 220 receives flow 250 of pressurized gas from canister 210. Upstream portion 222 provides flow 252 of pressurized gas to inlet 232 of tube 230. Upstream portion 222 provides flow 254 of pressurized gas to matching portion 224 of manifold 220. Matching portion 224 of manifold 220 receives flow 254 of pressurized gas from upstream portion 222. Matching portion 224 provides flow 256 of pressurized gas to downstream portion 226 of manifold 220. Matching portion 224 may transform a characteristic of flow 252, 254, and 256. Downstream portion 226 of manifold 220 receives flow 256 of pressurized gas. Downstream portion 226 provides flow 258 of pressurized gas to inlet 242 of tube 240. Downstream portion 226 may transform a characteristic of flow 256 and 258.

Providing a pressurized gas from a source (e.g., canister 210) that is physically proximate to one tube (e.g., tube 230) of two separated tubes may introduce timing and pressure differences at the inlet of each tube. Time and pressure differences may result in launching one electrode before another electrode. Differences in delivery of a pressurized gas may further result in exit velocities differences between the two or more electrodes.

Matching portion 224 transforms a characteristic of at least flow 254 and 256 to compensate for the differences to accomplish a correspondence of an exit velocity and/or an exit time of electrode 236 from tube 230 and electrode 246 from tube 240. A downstream portion may further transform at least flow 256 to accomplish a correspondence between electrode 236 and electrode 246.

After launch, electrode 236 deploys a filament from wire store 238 and electrode 246 deploys a filament from wire store 248. The filaments from wire stores 238 and 248 electrically couple to stimulus interface 150 to provide the stimulus signal through the target.

Figure 3:
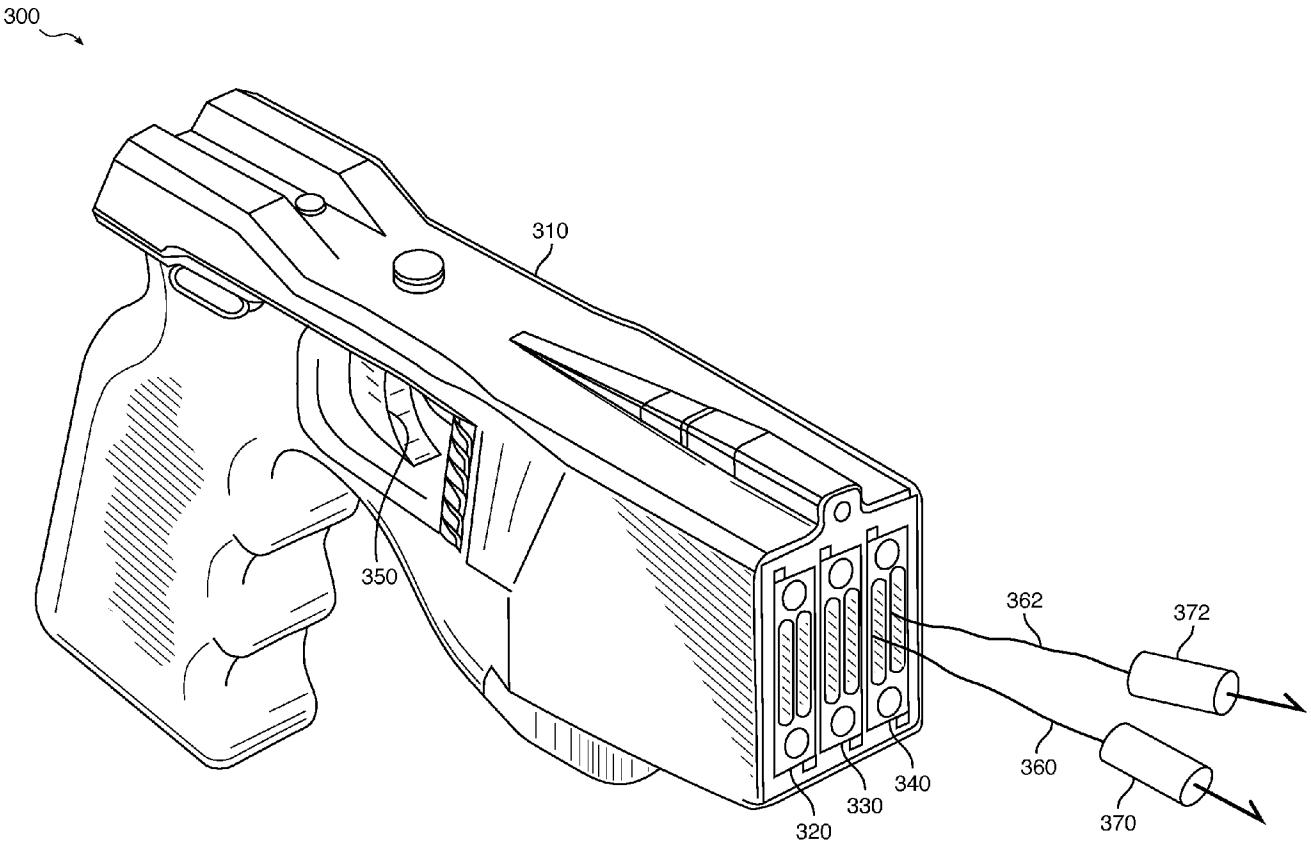
FIG. 3 is a perspective plan view of an implementation of the electronic weapon of FIG. 1.
Figure 4:
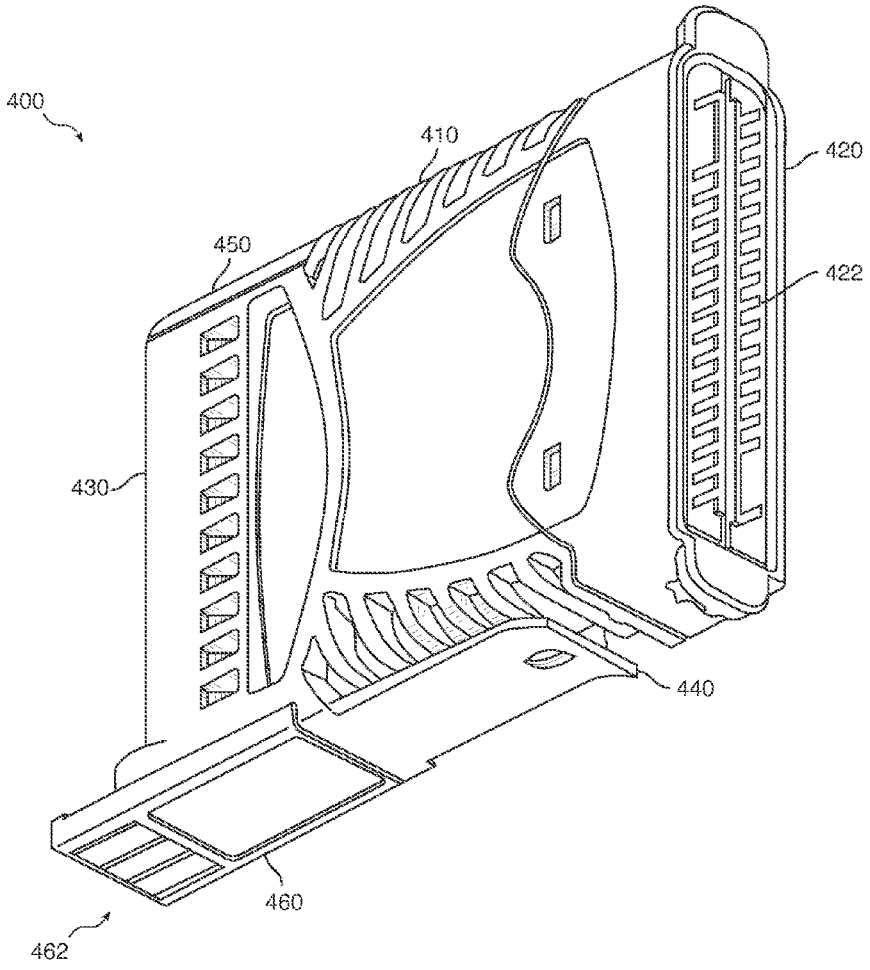
FIG. 4 is a perspective plan view of an implementation of the cartridge of FIGS. 1 and 2.
Figure 5:
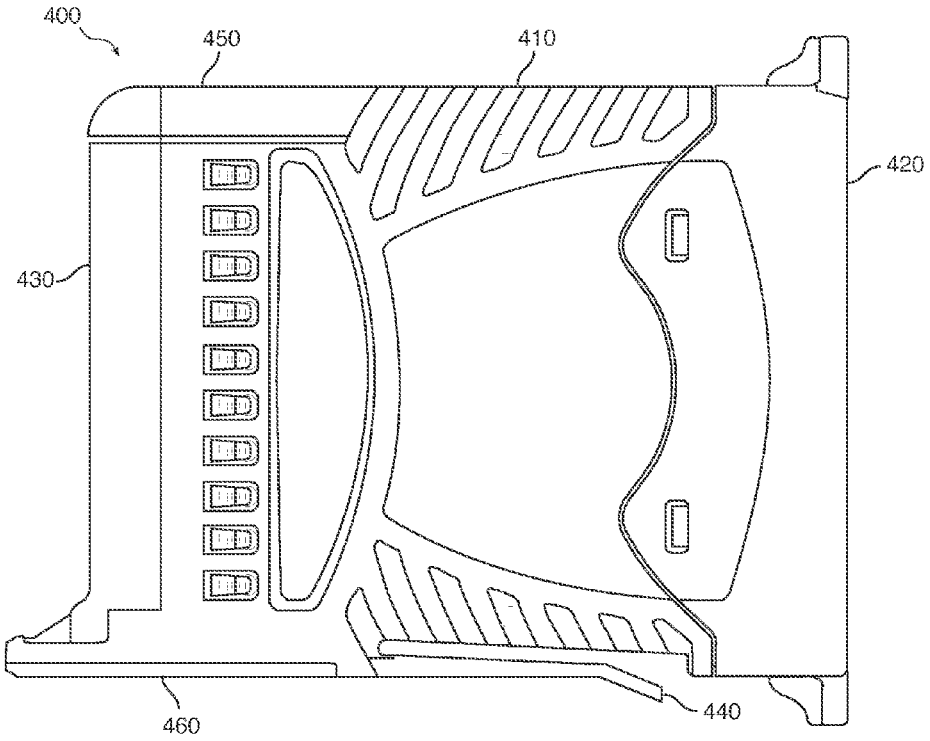
FIG. 5 is a side plan view of the cartridge of FIG. 4.
Figure 6:
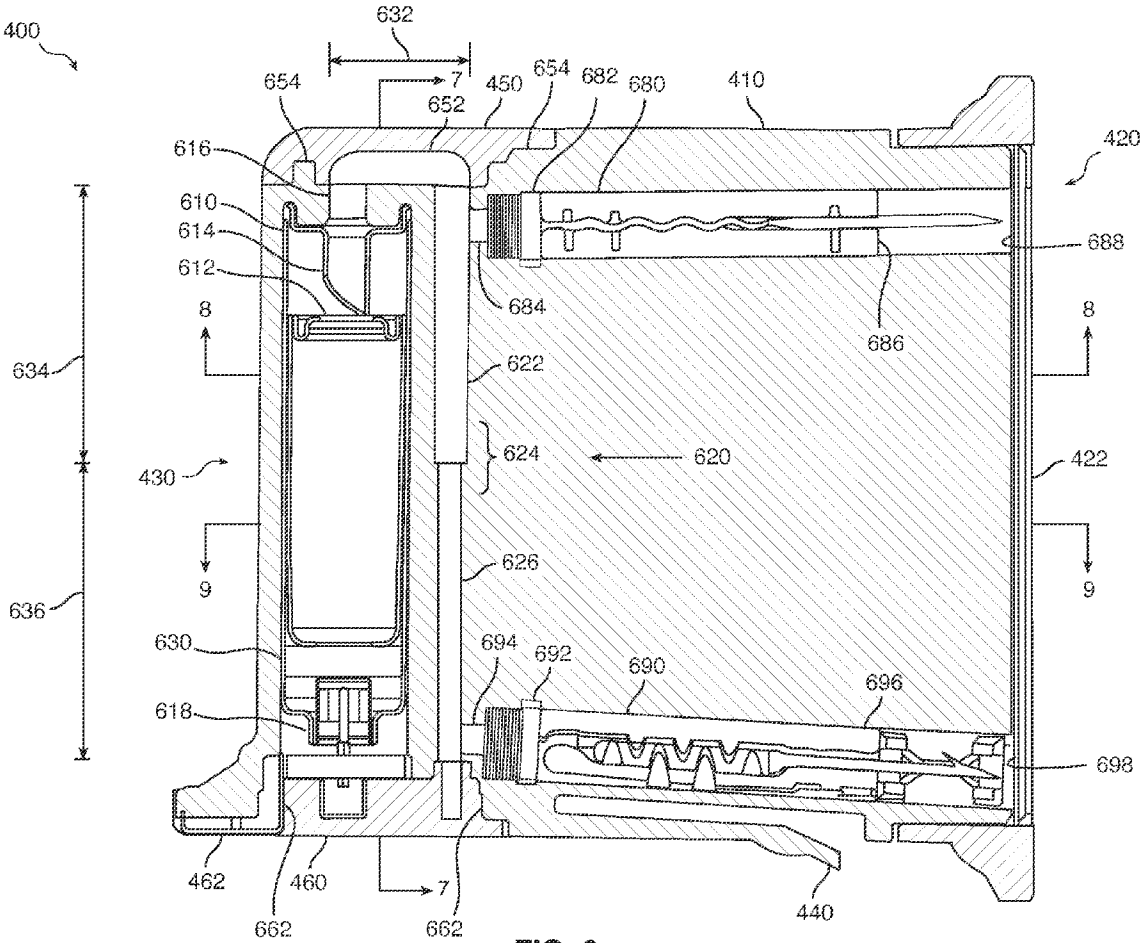
FIG. 6 is a central cross-section of the cartridge of FIG. 5.
Figure 7:
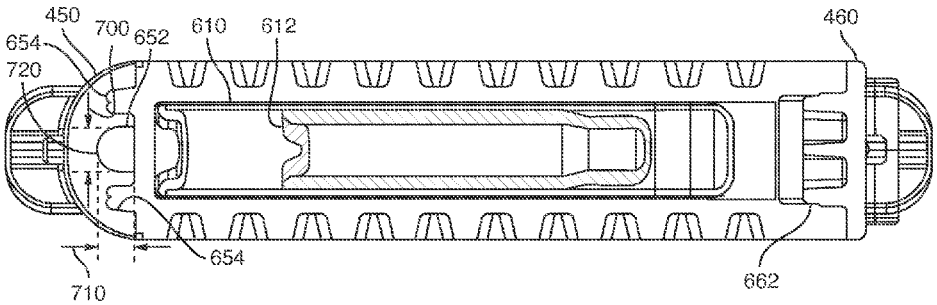
FIG. 7 is a cross-section of the cartridge of FIG. 5 at the plane indicated as 7-7.
Figure 8:
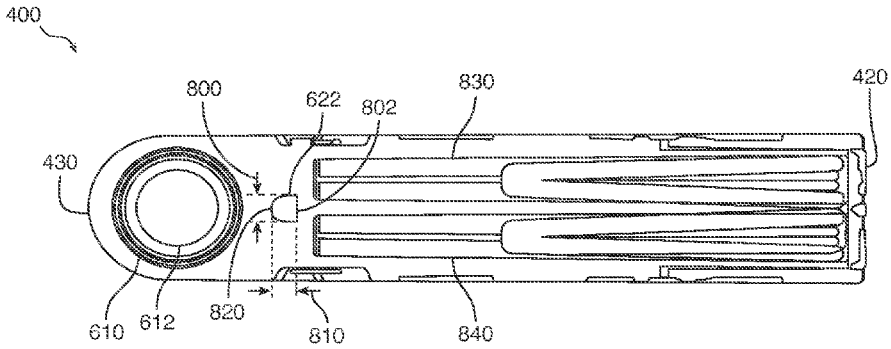
FIG. 8 is a cross-section of the cartridge of FIG. 5 at the plane indicated as 8-8.
Figure 9:
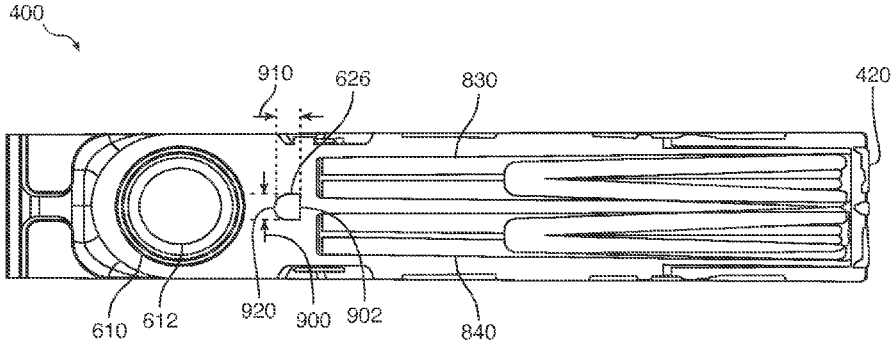
FIG. 9 is a cross-section of the cartridge of FIG. 5 at the plane indicated as 9-9.

In an implementation of weapon 100, electronic weapon 300 of FIG. 3 is shown immediately after a user initiated launch of two electrodes from a deployment unit. Electronic weapon 300 includes a hand-held launch device 310 that receives and operates three field-replaceable cartridges 320, 330, and 340 as a type of deployment unit. Each cartridge may be individually replaced.

Launch device 310 houses a power supply (having a replaceable battery), a processing circuit, and a signal generator as discussed above. Launch device 310 may be implemented as a conventional electronic control device marketed by TASER International, Inc. Cartridges 320, 330, and 340 each include two wire-tethered electrodes 370 and 372. Upon operation of trigger 350, electrodes 370 and 372 are propelled from cartridge 340 generally in direction of flight "A" toward a target (not shown). As electrodes 370 and 372 fly toward the target, electrodes 370 and 372 deploy behind them filaments 360 and 362 respectively. When electrodes 370 and 372 are positioned in or near a target, filaments 360 and 362 extend from cartridge 340 to electrodes 370 and 372 respectively. The signal generator provides a stimulus signal through the circuit formed by filament 360, electrode 370, target tissue, electrode 372, and filament 362. Electrodes 370 and 372 mechanically and electrically couple to tissue of the target as discussed above.

An implementation of cartridges 132, 134, 200, 320, 330, and 340 may include cartridge 400 as shown in FIGS. 4-9, which are drawn to scale. Cartridge 400 includes, inter alia, canister 610, manifold 620, tubes 680 and 690, electrodes 686 and 696, and wire stores 830 and 840 positioned in body 410. In operation, cartridge 400 is positioned in launch device 100 (310). Front portion 420 of body 410 is positioned toward a target (not shown). Rear portion 430 of body 410 is inserted into launch device 100 (310) and held in place by release 440. An operation of release 440 permits removal of cartridge 400 from launch device 100 (310).

Canister 610 includes capsule 612, anvil 614, initiator 618, and seal 630. Anvil 614 forms an exit to canister 610 to provide an expanding gas to exit 616. Exit 616 is formed in body 410. Canister 610, capsule 612, anvil 614, initiator 618, and seal 630 perform the functions of a canister, a capsule, an anvil, an initiator, and a seal as discussed herein.

Manifold 620 includes upstream portion 622, matching portion 624, and downstream portion 626. Manifold 620, upstream portion 622, matching portion 624, and downstream portion 626 perform the functions of a manifold, an upstream portion, a matching portion, and a downstream portion as discussed herein.

Tube 680 includes inlet 684, pad 682, and exit 688. Tube 690 includes inlet 694, pad 692, and exit 698. Tubes 680 and 690, inlets 684 and 694, pads 682 and 684, and exits 688 and 698 perform the functions of tubes, inlets, seals, and exits as discussed herein. Protective cover 422 covers exits 688 and 698 and wire stores 830 and 840. Protective cover 422 retains electrodes 686 and 696 in tubes 680 and 690 respectively prior to launch. Protective cover 422 protects electrodes 686 and 696 and wire in wire stores 830 and 840 from corrosion to some extent. During launch, protective cover 422 is removed from body 410 to permit electrodes 686 and 696 to exit tubes 680 and 690 respectively, deploy wires out of wire stores 830 and 840, and fly toward a target.

Canister 610 is positioned in a cavity of body 410. Manifold 620 is formed in body 410. Cap 450 mechanically couples and seals to body 410 at seals 654 to form port 652. Port 652 transports a flow of pressurized gas from exit 616 and from canister 610 to upstream portion 622 of manifold 620. Cover 460 mechanically couples and seals to body 410 at seals 662. Cover 460 seals an end portion of downstream portion 626 of manifold 620. Cover 460 prevents an escape of pressurized air from the end portion of downstream portion 626. Cover 460 further closes the cavity that contains canister 610 to retain canister 610 in body 410. Cover 460 includes electrical contacts 462 to provide launch signal 152 to initiator 618.

In an implementation, body 410, cap 450 and cover 460 are formed of plastic. A mechanical coupling of cap 450 and cover 460 to body 410 is accomplished by welding cap 450 and cover 460 to body 410 such that a force of about 450 pounds pressure is required to break the joint formed by the weld. The joint formed by welding further forms seals 654 and 662.

A canister may be formed of a material that provides sufficient structural strength to contain an explosive force of initiator 618. A canister may be formed of a material that resists corrosion. A material resistant to corrosion increases a shelf life of a cartridge. Sufficient strength includes strength to maintain the shape of the canister during and after ignition of initiator 618. A canister may bear a majority if not all of the force provided by ignition of initiator 618 to preserve the structure and integrity of body 410 and/or manifold 620. Materials that provide sufficient structure strength for a canister include stainless steel, titanium, other metals of similar structural strength, materials made of carbon wound filament and nano-materials. In one implementation, canister 610 is formed of 304 L stainless steel. Canister 610 is substantially cylindrical having a diameter of approximately 0.405 inches, a height of approximately 1.63 inches, and wall thickness of approximately 0.011 inches.

Anvil 614 mechanically couples (e.g., laser weld) to an open-end portion of canister 610. Anvil 614 includes at least one orifice, thus mechanically coupling anvil 614 to canister 610 forms an exit (e.g., orifice, passage) from canister 610 that fluidly couples to exit 616. Initiator 618 is positioned at an end portion of canister 610 opposite anvil 614. Initiator 618 electrically couples to contacts 462. Initiator 618 mechanically couples (e.g., laser weld) to canister 610 such that the force from activating initiator 618 does not permit an escape of gas from canister 610 via the end portion to which initiator 618 is coupled. Mechanical coupling further reduces movement of initiator 618 with respect to canister 610 during ignition. Capsule 612 is positioned in canister 610 between anvil 614 and initiator 618. Seal 630 is positioned between capsule 612 and initiator 618.

Capsule 612 is formed of a material having sufficient structural strength to contain a pressurized gas. Capsule 612 includes a container and a lid. Filling capsule 612 with a pressurized gas is accomplished by placing the container of capsule 612 in a pressurized environment and mechanically coupling (e.g., laser welding) the lid to the container while in the pressurized atmosphere. Mechanically coupling the lid to the container retains the pressurized gas in capsule 612 until capsule 612 is opened (e.g., punctured, pierced). The lid of capsule 612 may be scored to facilitate opening by anvil 614 to release the pressurized gas. In one implementation, capsule 612 is formed of stainless steel. The thickness of the walls of the container of capsule 612 is approximately 0.016 inches. The thickness of the lid is also approximately 0.016 inches.

As discussed above, the pressure of the gas contained in a capsule 612 may relate to a range (e.g., distance) of the electrodes to be launched by release of the gas. For example, capsule 612 contains nitrogen gas pressurized to about 2,750 psi for launching electrodes having a range of 25 and 35 feet. Nitrogen gas pressurized to about 2,400 psi is used to launch electrodes having a range of 15 feet.

Contacts 462 provide launch signal 152 to initiator 618. As discussed above, launch signal 152 ignites initiator 618 to produce a rapidly expanding gas. Seal 630 contains, at least initially, the rapidly expanding gas in canister 610. The rapidly expanding gas moves seal 630 against capsule 612 and capsule 612 against anvil 614. A force provided by the rapidly expanding gas against seal 630 and capsule 612 is sufficient for anvil 614 to open capsule 612. Upon opening, the pressurized gas contained in capsule 612 exits capsule 612, flows through an orifice in anvil 614 and into exit 616. Because seal 630 retains the expanding gas from initiator 618 in canister 610 until some time after the release of pressurized gas from capsule 612, the pressurized gas form capsule 612 provides the propelling force to propel one or more electrodes and not initiator 618. The force provided by initiator 618 is used merely to open capsule 612, which in turn provides the propelling force.

Port 652, formed by welding cap 450 to body 410, as discussed above, transports the flow of pressurized gas from opened capsule 612 via exit 616 to upstream portion 622 of manifold 620. In one implementation, exit 616 is a bore having a diameter of about 0.125 inches. Port 652 is a "D" shaped passage. Height 700 of the "D" shaped passage is about 0.125 inches. Width 710 of the "D" shaped passage is about 0.125 inches. Radius of curvature 720 of the "D" shaped passage is about 0.055 inches. Length 632 of port 652 is about 0.55 inches.

As discussed above, a flow of pressurized gas from port 652 enters upstream portion 622 of manifold 620. In one implementation, upstream portion 622 of manifold 620 is a "D" shaped passage. Height 800 of wall 802 of the "D" shaped passage is about 0.125 inches. Width 810 of the "D" shaped passage is about 0.125 inches. Radius of curvature 820 of the "D" shaped passage is about 0.055 inches. Length 634 of upstream portion 622 is about 0.827 inches.

Inlet 684 is positioned proximate to the intersection of port 652 and upstream portion 622. Inlet 684 is a bore having a diameter of about 0.1 inches. Inlet 684 fluidly couples through wall 802 into the "D" shaped passage of upstream portion 622. Fluidly coupling through wall 802 into a "D" shaped passage increases a likelihood of not forming flash at inlet 684 when forming body 410 of plastic using an injection molding process. Reducing a likelihood of forming flash at inlet 684 reduces the likelihood of forming an obstruction to inlet 684 that may affect launch of electrode 686 from tube 680.

In one implementation, downstream portion 626 of manifold 620 is a "D" shaped passage. Height 900 of wall 902 of the "D" shaped passage is about 0.093 inches. Width 910 of the "D" shaped passage is about 0.093 inches. Radius of curvature 920 of the "D" shaped passage is about 0.047 inches. Length 636 of downstream portion 626 is about 0.906 inches.

Inlet 694 is positioned distal from to the intersection of port 652 and upstream portion 622 and a distance away from matching portion 624. Inlet 694 is a bore having a diameter of about 0.1 inches. Inlet 694 fluidly couples through wall 902 into the "D" shaped passage of downstream portion 626. Fluidly coupling through wall 902 into a "D" shaped passage reduces formation of flash as discussed above.

Matching portion 624 of manifold 620 includes the transition from the "D" shaped passage of upstream portion 622 with the "D" shaped passage of downstream portion 626. The transition includes the termination of the larger "D" shaped passage of upstream portion 622 and the start of the smaller "D" shaped passage of the downstream portion 626. Movement of a flow of gas across the transition, in either direction, transforms a characteristic of the flow of gas.

Figure 10:
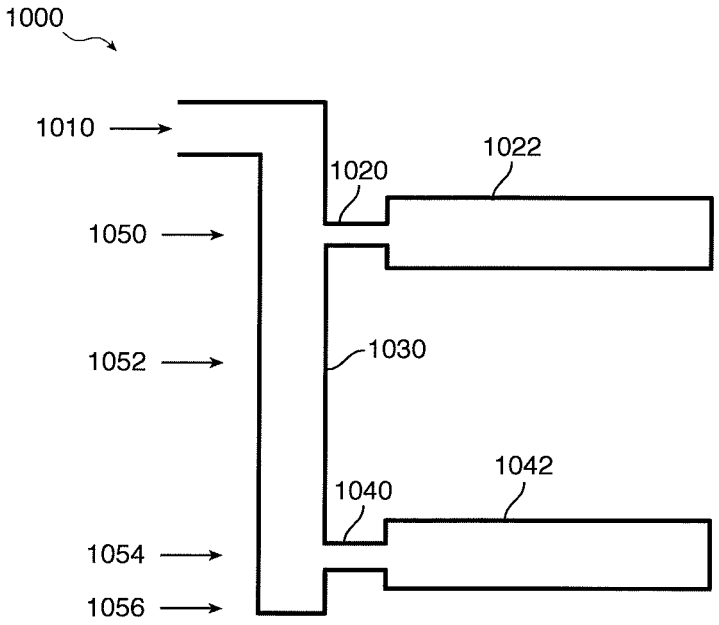
FIG. 10 is a model of a manifold.
Figure 11:
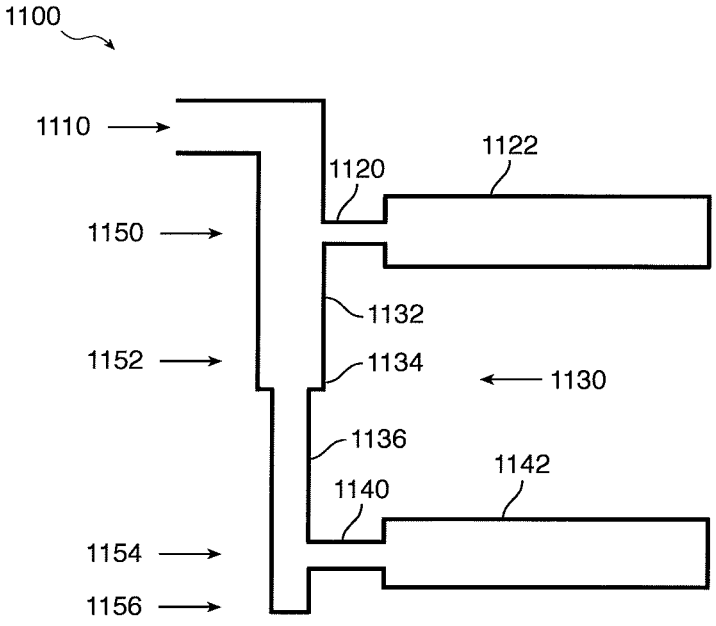
FIG. 11 is a model of the manifold of the cartridge of FIG. 4.
Figure 12:
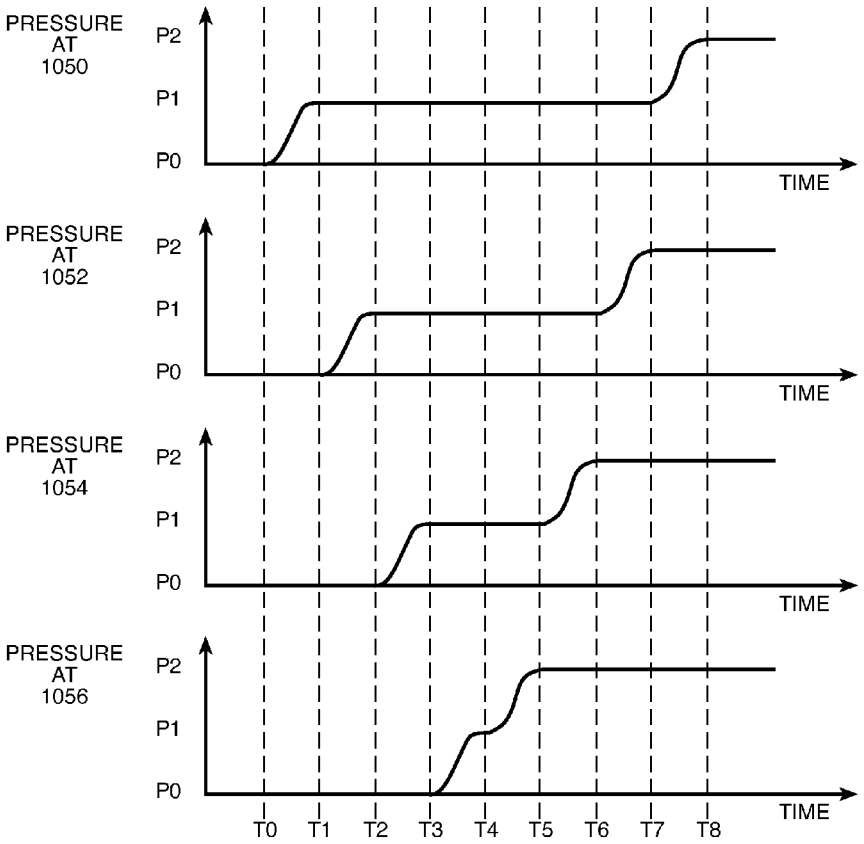
FIG. 12 is a pressure-time graph of the model of FIG. 10.
Figure 13:
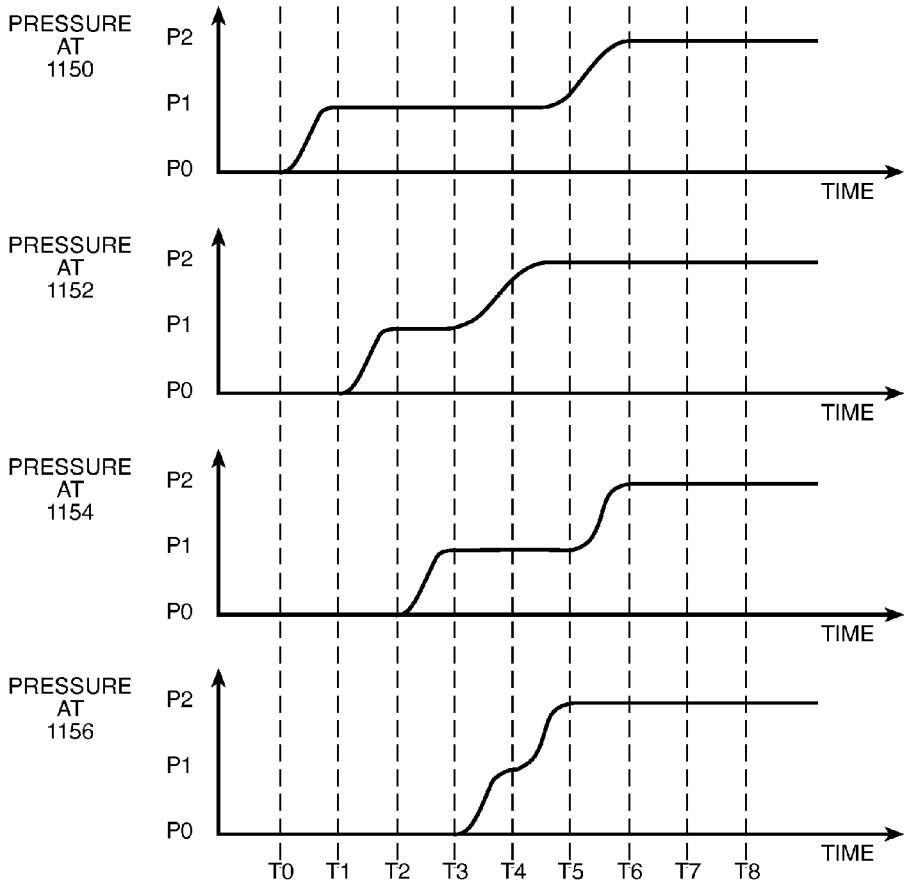
FIG. 13 is a pressure-time graph of the model of FIG. 11.

Mathematical simulations provide an understanding of the function performed by a matching portion. Simulation model 1000 of FIG. 10 models a manifold that does not include a matching portion. Model 1000 includes a manifold having similar proportions throughout the length of the manifold. Pressurized gas is introduced at inlet 1010. Pressure is analyzed at locations 1050-1056 over time. Simulation model 1100 of FIG. 11 models a manifold that includes upstream portion 1132, matching portion 1134, and downstream portion 1136. The manifold of model 1100 has the proportions and analysis discussed above. Pressurized gas is introduced at inlet 1110. Pressure is analyzed at locations 1150-1156 over time. Inlets 1020 and 1120 feed tube 1022 and 1122 respectively. Inlets 1040 and 1140 feed tube 1042 and 1142 respectively. An electrode launches from a tube when the pressure at the inlet of the tube reaches P2 as shown in FIGS. 12-13.

In the simulation of model 1000, pressurized gas is released into inlet 1010 of vacated manifold 1030 at time T0. Pressure at location 1050 increases to pressure P1 by time T1. As the flow of pressurized gas continues to move toward a lower portion (e.g., distal from gas inlet 1010) of manifold 1030, pressure at location 1052 increases to pressure P1 by time T2, pressure at location 1054 increases to P1 by time T3 and pressure at location 1056 increases to pressure P1 by time T4. Location 1056 is the end of manifold 1030. The end of manifold 1030 is blocked such that the pressurized air cannot escape. As pressurized air continues to enter manifold 1030, pressure at location 1056 increases to pressure P2 by time T5.

The increase of pressure experienced at the closed end of manifold 1030 moves upstream so that the pressure at locations 1054, 1052, and 1050 increase to pressure P2 by times T6, T7, and T8 respectively. Because an electrode launches when the inlet of a tube reaches pressure P2, the electrode of tube 1042 launches at time T6 and the electrode of tube 1022 launches at time T8. The correspondence between a time of exit of the electrode of tube 1022 and the electrode of tube 1042 is not close. Additional simulations, not shown herein, show that the correspondence between the exit velocities of the electrodes is also not close.

In the simulation of model 1100, pressurized gas is released into inlet 1110 of vacated manifold 1130 at time T0. Pressure at location 1050 increases to pressure P1 by time T1. As the flow of pressurized gas continues to move through upstream portion 1132 toward matching portion 1134, the pressure at location 1052 increases to pressure P1 by time T2. The flow of pressurized gas continues moving downstream until it reaches (e.g., arrives at, flows to, traverses, flows through, impinges upon, collides with, interacts with) matching portion 1134.

Matching portion 1134, in the simulation of this embodiment, is a constriction of the cross-sectional area of manifold 1130. As the flow of pressurized air reaches matching portion 1134, the constriction causes an increase in pressure at matching portion 1134. Even as pressurized air flows past matching portion 1134 and into downstream portion 1136, a portion of the flow of pressurized air impinges on matching portion 1134 thereby increasing the magnitude of the pressure of the pressurized gas at matching portion 1134. The increase in pressure caused by matching portion 1134 begins to move upstream so that the pressure at locations 1152 and 1150 increase to pressure P2 by times T4 and T6 respectively. Because manifold 1130 is not completely constricted at matching portion 1134, the increase in pressure that results from the constriction of matching portion 1134 may be less rapid than the increase experienced at location 1156.

The air that flows through matching portion 1134 results in increases in pressure at locations 1154 and 1156 to pressure P2 at times T5 and T6 as described above with respect to locations 1054 and 1056. The restriction manifold 1130 past matching portion 1134 may further increase a rate of flow of the pressurized air in downstream portion 1136. Because an electrode launches when the inlet of a tube reaches pressure P2, the electrode of tube 1122 and the electrode in tube 1142 launch at time T6. Matching portion 1134 of manifold 1130 transformed a characteristic of the pressurized gas in manifold 1130, which provided an increased correspondence between an exit velocity and/or a time of exit of the electrode of tube 1122 and the electrode of tube 1142.

Because the propelling force to launch the electrodes of cartridges 100, 200 and 400 comes from a single source and the source fluidly couples to the manifold and the tubes that launch the electrodes, respective times of exit of the electrodes that fall within a range produce exit velocities of the electrodes that correspond. For example, referring to FIG. 6, exit 616, port 652, manifold 620, inlets 684 and 694, and tubes 680 and 690 are in continuous fluid communication. As the magnitude of the pressure of the pressurized gas increases at inlet 684 and 694, seals 682 and 692 and electrodes 686 and 696 are propelled toward exits 688 and 698 respectively. As long as seals 684 and 694 are positioned in their respective tubes, they retain the pressurized gas in the areas of fluid communication. Once a seal exits its tube, the areas in fluid communication are suddenly in fluid communication with the atmosphere and the magnitude of the pressure in exit 616, port 652, manifold 620, inlets 684 and 694, and tubes 680 and 690 decreases rapidly.

If a seal is ejected from its tube before the electrodes in the other tubes attain sufficient velocity to accomplish a desired launch, the rapid decrease in the magnitude of the pressure in exit 616, port 652, manifold 620, inlets 684 and 694, and tubes 680 and 690 may interfere with launching of other electrodes. Each electrode accelerates and gains sufficient velocity to exit the cartridge prior to the sudden decrease in the magnitude of the pressure within the cartridge. Thus, the time of exit of the electrodes corresponds within a finite range (e.g., window) or some electrodes may not be launched.

When the pressurized gas attains a magnitude of pressure sufficient to launch electrodes (e.g., launch pressure), it is applied to each tube within the window of time. The window of time begins the moment the pressurized gas at the launch pressure is applied to a first tube. The window of time ends when any one seal exits its tube. During the window of time, each electrode receives the propelling force and accelerates. If the pressurized gas at launch pressure is applied too late to a tube, exit velocity may be insufficient.

Actual launches of electrodes from prototype manifolds showed that locating the matching portion downstream, (e.g., farther from port 652) resulted in the downstream dart launching prior to the upstream dart and with a higher exit velocity. Additional prototypes further showed that increasing the cross-sectional area (e.g., diameter) of the manifold resulted in lower exit velocity because of a concomitant decrease in pressure in the manifold and at the tube inlets. A decrease in the cross-sectional area of the manifold resulted in higher gas pressure in the manifold with a decrease in exit velocity because the rate of fluid flow was not sufficient to accomplish a launch at a higher velocity. Prototypes further revealed that a manifold having a circular cross-sectional area (e.g., bore) provided adequate performance; however, the "D" shaped passage was selected to improve manufacturability.

Simulations and prototypes confirmed that a manifold having the measurements and proportions discussed above falls within a range of dimensions and ratios that provide an increased correspondence between an exit velocity and/or a time of exit of electrodes launched from a cartridge. Actual testing further showed that electrodes launched from cartridges having ranges of 25 and 35 feet exited the cartridge at approximately the same time and at approximately 165 feet/second+/−5 feet/second. Electrodes launched from a cartridge having a range of 15 feet exited at approximately the same time and at approximately 145 feet/second+/−5 feet/second.

EXAMPLES OF THE INVENTION

A deployment unit launches a first wire-tethered electrode and a second wire-tethered electrode toward a target to provide a current through the target to inhibit voluntary movement by the target. The deployment unit includes a manifold and a canister. The manifold includes an upstream portion, a matching portion, and a downstream portion. The canister provides a pressurized gas. The upstream portion of the manifold provides the pressurized gas to a first tube to launch the first electrode. The downstream portion of the manifold provides the pressurized gas to a second tube to launch the second electrode. The matching portion of the manifold transforms a characteristic of the pressurized gas to increase a correspondence between an exit velocity of the first electrode and an exit velocity of the second electrode.

A method, performed by a deployment unit, launches a first wire-tethered electrode and a second wire-tethered electrode toward a target to provide a current through the target, to inhibit voluntary movement by the target. The method includes in any practical order: (a) receiving a flow of pressurized gas into an upstream portion of a manifold to apply to a first electrode for launching the first electrode; (b) receiving the flow of pressurized gas from the upstream portion into a downstream portion of the manifold to apply to the second electrode for launching the second electrode; and (c) transforming a characteristic of the pressurized gas after entry into the downstream portion. Transforming causes the exit velocities of the first and second electrodes to more closely correspond.

A deployment unit housing includes structures for launching a first wire-tethered electrode and a second wire-tethered electrode toward a target to provide a current through the target to inhibit voluntary movement by the target. The deployment unit housing includes a manifold, a first tube, a second tube, and a canister. The manifold includes an upstream portion, a matching portion, and a downstream portion. The matching portion is in fluid communication with both the upstream portion and the downstream portion. The first tube is for housing the first electrode. The second tube is for housing the second electrode. The first tube is in fluid communication with the upstream portion to launch the first electrode. The second tube is in fluid communication with the downstream portion to launch the second electrode. The canister provides a pressurized gas to the upstream portion of the manifold that then flows through the matching portion and into the downstream portion. The matching portion transforms a characteristic of the pressurized gas to increase a correspondence between respective exit velocities and/or exit times of the first electrode and the second electrode.

A deployment unit launches a first wire-tethered electrode and a second wire-tethered electrode toward a target to provide a current through a target to inhibit voluntary movement by the target. The deployment unit includes a body, a cavity, a canister, a cap, a manifold, an initiator, a cover, first and second tubes, and first and second electrodes housed in the first and second tubes. The cavity is a feature of the body. The canister is installed in the cavity. The cap mechanically couples to the body to form a port. The manifold, also a feature of the body, includes, an upstream portion, a matching portion, and a downstream portion. The port couples by fluid communication an end of the canister and the upstream portion of the manifold. An initiator is installed at the other end of the canister. The cover mechanically couples to the body to close the cavity and to close the downstream portion of the manifold. The upstream portion of the manifold is in fluid communication with the first tube to launch the first electrode. the downstream portion of the manifold is in fluid communication with the second tube to launch the second electrode. In operation, the initiator cooperates with the canister to produce gas. The gas flows through the port and into the manifold. The gas flows from the upstream portion into the first tube and from the upstream portion into the matching portion. The gas flows from the matching portion into the downstream portion and from the downstream portion into the second tube. The matching portion increases the pressure in the downstream portion and the second tube. Consequently, there is increased correspondence between the respective exit velocities and exit times for the first and second electrodes.

The foregoing description discusses preferred embodiments of the present invention, which may be changed or modified without departing from the scope of the present invention as defined in the claims. Examples listed in parentheses may be used in the alternative or in any practical combination. As used in the specification and claims, the words 'comprising', 'including', and 'having' introduce an open ended statement of component structures and/or functions. In the specification and claims, the words 'a' and 'an' are used as indefinite articles meaning 'one or more'. While for the sake of clarity of description, several specific embodiments of the invention have been described, the scope of the invention is intended to be measured by the claims as set forth below.

What is claimed is:

1. A deployment unit for providing a current through a provided target, the deployment unit comprising:

a body comprising a first tube, a second tube, and a cavity;

a first electrode positioned in the first tube;

a second electrode positioned in the second tube; and a canister positioned in the cavity, the canister for providing a pressurized gas to the first tube and the second tube to launch the first electrode and the second electrode toward the target to provide the current through the target, the current for inhibiting voluntary movement by the target; wherein with respect to a direction of travel of the first electrode toward the target, the cavity is positioned in the body rearward of the first tube and the second tube; wherein the body further comprises a passage that fluidly couples the cavity to the first tube and the second tube; and the passage directs a flow of the pressurized gas from an outlet of the cavity to an inlet of the first tube and an inlet of the second tube.

2. The deployment unit of claim 1 wherein as the pressurized gas traverses the passage from the canister to at least one of the first tube and the second tube, a direction of the flow of pressurized gas changes three times.

3. The deployment unit of claim 2 above wherein a magnitude for each change of direction of the flow of pressurized gas is about 90 degrees.

4. A deployment unit for providing a current through a provided target, the deployment unit comprising:

a body comprising a first tube, a second tube, and a cavity;

a first electrode positioned in the first tube;

a second electrode positioned in the second tube; and a canister positioned in the cavity, the canister for providing a pressurized gas to the first tube and the second tube to launch the first electrode and the second electrode toward the target to provide the current through the target, the current for inhibiting voluntary movement by the target; wherein with respect to a direction of travel of the first electrode toward the target, the cavity is positioned in the body rearward of the first tube and the second tube; wherein the deployment unit further comprises a cap;

the body further comprises a passage;

the cap couples to the body to form a portion of the passage;

the passage fluidly couples the cavity to the first tube and the second tube; and the passage directs a flow of the pressurized gas from an outlet of the cavity to an inlet of the first tube and an inlet of the second tube.

5. A deployment unit for providing a current through a provided target, the deployment unit comprising:

a body comprising a first tube and a cavity, the first tube having a first axis along a length of the first tube;

a first electrode positioned in the first tube; and a canister positioned in the cavity, the canister having a second axis along a length of the canister, the canister for providing a pressurized gas to the first tube to launch the first electrode toward the target to provide the current through the target, the current for inhibiting voluntary movement by the target; wherein as the pressurized gas traverses the passage from the canister to the first tube, a general direction of flow of pressurized gas changes more than once.

6. The deployment unit of claim 5 wherein a cumulative magnitude for all changes of direction of flow of pressurized gas is more than 180 degrees.

7. A deployment unit for providing a current through a provided target, the deployment unit comprising:

a body comprising a first tube, a cavity, and a passage, the passage fluidly couples the cavity to the first tube;

a first electrode positioned in the first tube;

a canister positioned in the cavity, the canister for providing a pressurized gas to launch the first electrode toward the target to provide the current through the target, the current for inhibiting voluntary movement by the target; wherein:

the passage directs a flow of the pressurized gas from an outlet of the cavity to an inlet of the first tube; and as the pressurized gas traverses the passage from the canister to the first tube, a general direction of flow of pressurized gas changes at least three times.

8. The deployment unit of claim 7 wherein:

the deployment unit further comprises a cap; and the cap couples to the body to form a portion of the passage.

9. The deployment unit of claim 7 further comprising a cover, wherein the cover couples to the body to close the cavity.

10. The deployment unit of claim 7 wherein:

the first tube has a first axis along a length thereof;

the canister has a second axis along a length thereof;

an orientation of the first axis to the second axis is about 90 degrees.

11. The deployment unit of claim 7 wherein with respect to a direction of travel of the first electrode toward the target, the cavity is positioned in the body rearward of the first tube.

12. The deployment unit of claim 7 further comprising a second electrode, wherein:

the body further comprises a second tube;

the second electrode is positioned in the second tube;

the canister for further providing the pressurized gas to the second tube to launch the second electrode toward the target to provide the current;

the passage further directs the flow of the pressurized gas from an outlet of the cavity to an inlet of the second tube; and as the pressurized gas traverses the passage from the canister to the second tube, the general direction of flow of pressurized gas changes at least three times.

13. The deployment unit of claim 12 wherein:

the second tube has a first axis along a length thereof;

the canister has a second axis along a length thereof;

an orientation of the first axis to the second axis is about 90 degrees.

14. The deployment unit of claim 12 wherein with respect to a direction of travel of the second electrode toward the target, the cavity is positioned in the body rearward of the second tube.

* * * * *